United States Patent [19]

Proud

[11] 4,296,579

[45] Oct. 27, 1981

[54] SCREEN PANEL

[76] Inventor: Norman Proud, 16 West St., Oakville, Ontario, Canada, L6L 2Y6

[21] Appl. No.: 37,563

[22] Filed: May 9, 1979

[51] Int. Cl.[3] ..... E04B 2/72; A47G 5/00

[52] U.S. Cl. ..... 52/239; 52/36

[58] Field of Search ..... 52/239, 238, 36; 160/378, 369, 135, 351

[56] References Cited

U.S. PATENT DOCUMENTS

| | | | |
|---|---|---|---|
| 3,289,368 | 12/1966 | Mark | 52/239 X |
| 3,449,877 | 6/1969 | Beckman | 52/238 |
| 3,768,222 | 10/1973 | Birum | 52/239 |
| 3,949,827 | 4/1976 | Witherspoon | 52/239 X |
| 4,021,973 | 5/1977 | Hegg | 52/36 |
| 4,031,675 | 6/1977 | Roberts et al. | 52/36 |
| 4,060,294 | 11/1977 | Haworth et al. | 52/239 X |
| 4,090,335 | 5/1978 | Curatolo | 52/239 |
| 4,112,643 | 9/1978 | Decker | 160/135 X |
| 4,213,493 | 7/1980 | Haworth | 160/351 |

*Primary Examiner*—J. Karl Bell

*Attorney, Agent, or Firm*—Rogers, Bereskin & Parr

[57] ABSTRACT

A screen panel for office partitioning, in which fabric covered sleeves having a wire subframe are removably mounted on projecting clips on the panel frame. The sleeves can be removed or installed by stretching their wire subframes, facilitating repair of damaged or torn fabric. Wiring channels are placed on the panel frame and have openings facing the resilient fabric of the sleeves and spaced slightly therefrom. Wires can be inserted in the channels by deforming the fabric to push the wire through the small space between the wiring channels and the fabric.

6 Claims, 8 Drawing Figures

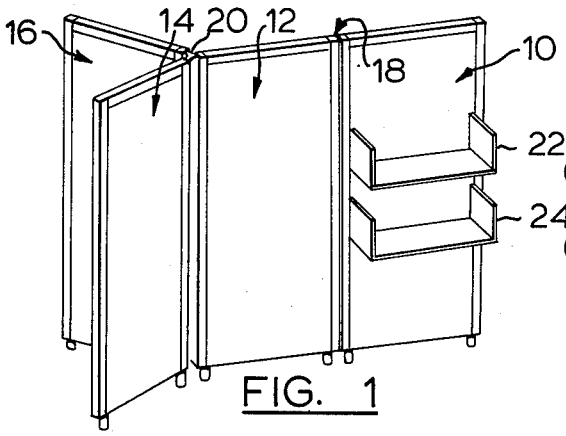
FIG. 1
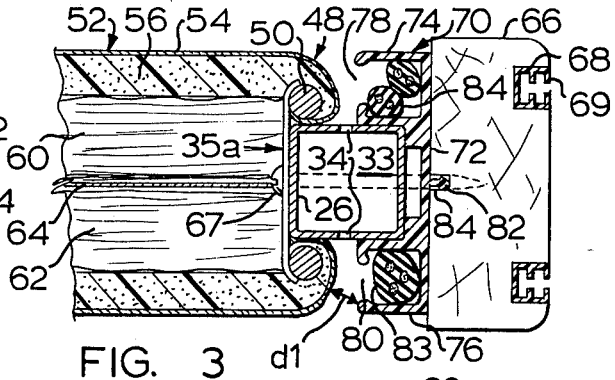
FIG. 3
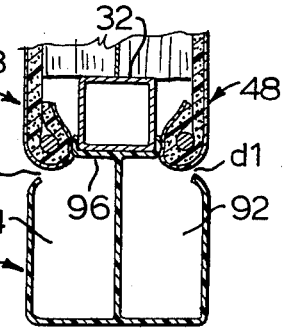
FIG. 8
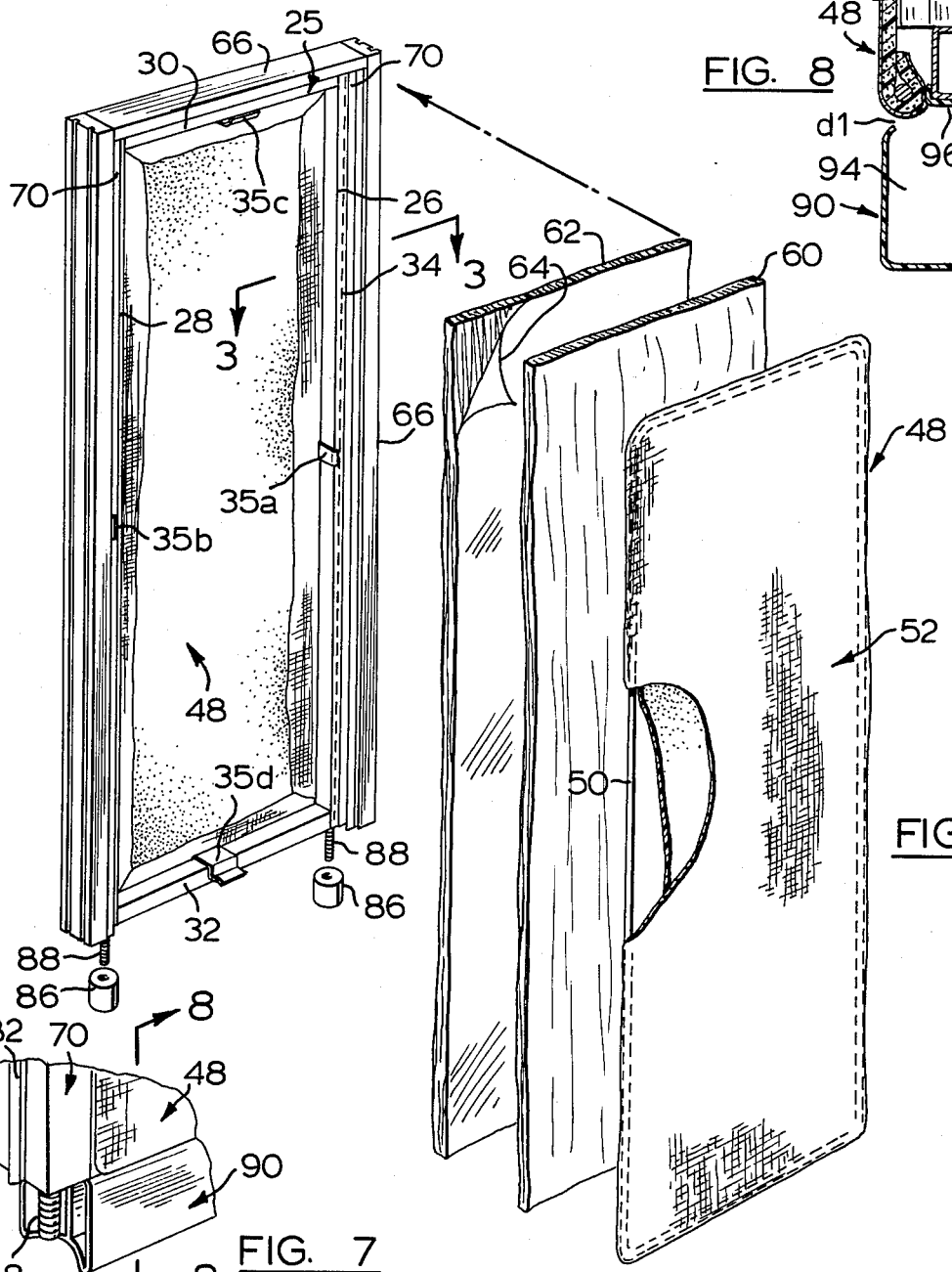
FIG. 2
FIG. 7

FIG. 4
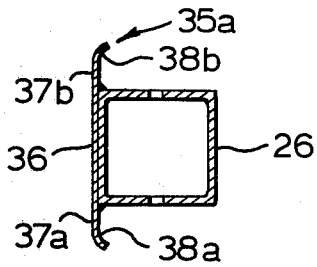
FIG. 5
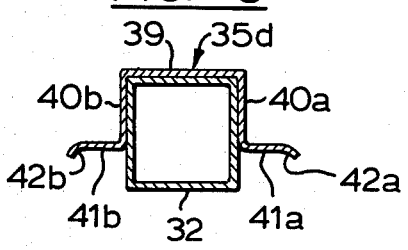
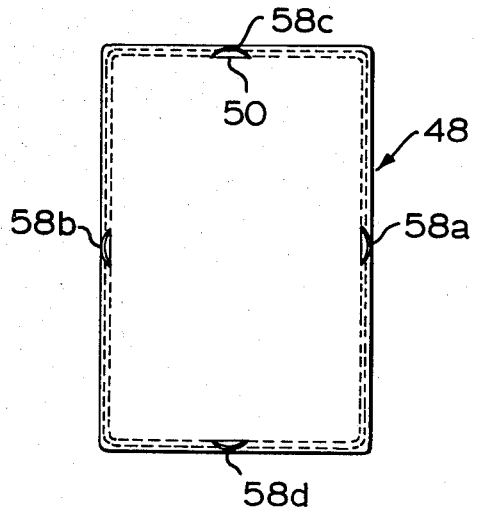
FIG. 6

SCREEN PANEL

This invention relates to a screen panel.

Screen panels are commonly used to divide an office area into numerous work areas and to reduce the transmission of noise from one work area to another. A disadvantage of present panels is that they can not be conveniently repaired if their fabric surfaces are damaged and they do not have means for conveniently handling electrical and telephone cables running through the work areas.

In one of its aspects the invention provides a panel comprising (a) a frame for said panel, said frame having a closed perimeter and defining front and rear planar surfaces spaced apart in a front to rear direction and extending in parallel lateral planes, (b) a plurality of clips fixed to said frame and spaced around the perimeter of said frame, some of said clips being associated with said front surface and some of said clips being associated with said rear surface, each clip having a support portion extending in said front to rear direction beyond its associated front or rear surface and a retainer portion extending from the outer end of said support portion and directed outwardly in a direction having a component parallel to a said lateral plane, (c) two sleeves, each sleeve having (i) a subframe comprising a flexible wire rod which defines a closed perimeter, (ii) a fabric material extending across said subframe and covering said wire rod, (d) said wire rod of one sleeve being fitted over said support portions of said clips associated with said front surface and said wire rod of the other sleeve being fitted over said support portions of said clips associated with said rear surface, whereby a said sleeve may be removed from said panel by deforming a portion of its wire rod in a direction generally laterally outwardly to move such portion clear of the retaining portion of a clip on which such portion is fitted, and then moving such portion outwardly in a front to rear direction, away from said frame.

In a further aspect the invention provides a screen panel comprising (a) a rectangular frame having a front, a rear, and a pair of vertical edge members, (b) a pair of flexible vertically extending channel members one fixed over each edge member, said channel members having opposed inner channel openings and free outer edges bounding said channel openings, (c) a fabric material extending between said edge members and located between said channel members and having a pair of vertical fabric edges spaced from said free outer edges by distances which are small, (d) said fabric material being deformable so that a cable can be forced through the opening between a said fabric edge and the edge of said channel member and inserted in the opening of such channel member for retention therein.

Advantages that can be achieved by use of the present invention will become apparent from the following description of a preferred embodiment, considered together with the accompanying drawings in which:

FIG. 1 is a perspective view of four screen panels constructed according to a preferred embodiment of the invention connected together to form a screen panel system;

FIG. 2 is a partially exploded perspective view of a screen panel of FIG. 1; FIG. 3 is a sectional view along the line 3—3 of FIG. 2;

FIG. 4 is a sectional view showing a side frame member and clip of the panel of FIG. 2;

FIG. 5 is a sectional view showing a bottom frame member and clip of the panel of FIG. 2;

FIG. 6 is a rear view of a sleeve of the panel of FIG. 2;

FIG. 7 is a partial perspective view of a wire guiding attachment for the base of the panel of FIG. 2; and FIG. 8 is a sectional view along the line 8—8 of FIG. 7.

Reference is first made to FIG. 1 which shows four identical screen panels 10, 12, 14 and 16 constructed according to a preferred embodiment of the invention. Panels 10 and 12 are connected together by a conventional hinge assembly 18 and panels 12, 14 and 16 are connected together by a conventional hinge assembly 20 to form a screen panel system. Mounted on panel 10 are shelves 22 and 24.

As shown in FIGS. 2 and 3, the panel 10 has a rectangular steel frame 25 consisting of vertical members 26 and 28 and horizontal members 30 and 32 which are welded together. Preferably, the frame members 26, 28, 30 and 32 are of square tubing and hence have hollow interiors 33 (FIG. 3).

The vertical frame members 26 and 28 are provided with vertical aligned rectangular vertical slits 34 on their frontward and rearward facing surfaces to allow access to their hollow interiors 33. The slits 34 receive the standard shelf brackets (not shown) of the shelves 22 and 24 (FIG. 1).

Four rigid steel clips 35*a*, 35*b*, 35*c*, 35*d* are welded to the inside surfaces of the frame members 26, 28, 30, 32 respectively. The clips 35*a*, 35*b*, 35*c*, are all identical and (see FIG. 4) each has a flat mounting portion 36 which overlies and is welded to its frame member, two support portions 37*a* and 37*b* which extend in a front to rear direction beyond the planes of the front and rear surfaces of the frame, and curved retaining portions 38*a*, 38*b* which extend laterally outwardly. The clip 35*d* (FIG. 5) is the same as the clips 35*a*, 35*b*, 35*c* except that its mounting portion 39 has two downwardly extending legs 40*a*, 40*b* overlying and welded to the sides of the bottom frame member 32, so that the support portions 41*a*, 41*b* of clip 35*d* are located near the bottom of frame member 32. Retaining portions 42*a*, 42*b* of clip 35*d* curve laterally outwardly as in the other clips.

The clips 35*a* to 35*d* serve to retain fabric sleeves 48 as best shown in FIGS. 2, 3 and 6. Two sleeves 48 are provided, one for the front and one for the rear of the panel 10. Each sleeve 48 has a subframe consisting of a resilient wire rod 50 formed into a planar rectangular configuration and having a closed perimeter. The rod subframe 50 is covered by a laminated fabric material 52 consisting (see FIG. 3) of an outer layer of fabric 54 backed by an inner layer of foam padding 56. The padding 56 is typically glued to the fabric 54. The laminated material 52 extends across the rod subframe 50 and extends over the edges of the rod. The edges of the material 52 are fastened (by glue or staples) to the inwardly facing surface of the padding 56.

At the location where the sleeves 48 are to be pushed onto the clips 35*a* to 35*d*, the material 52 is slit, as indicated at 58*a*, 58*b*, 58*c*, 58*d* in FIG. 6, to expose the inner surface of the rod subframe 50.

A sleeve 48 is installed on the panel frame 25 by fitting the exposed top portion of rod subframe 50 over upper clip 35*c*, then fitting the exposed side portions of rod subframe 50 over side clips 35*a*, 35*b*, and then fitting the exposed bottom portion of rod subframe 50 over bottom clip 35*d*. During this process the rod subframe 50 will be stretched or enlarged laterally outwardly to fit over the retaining portion of the clips. When it is released, the rod subframe will snap back to its original shape and will be retained by the clips as shown in FIG. 3. The sleeves 48 may similarly be removed by inserting a screwdriver between the frame 25 and the rod subframe 50 and prying the rod laterally outwardly to remove it from the clips 35*a* to 35*d*. Thus if the fabric of sleeve 50 has been torn or damaged, the sleeve can quickly and easily be replaced by an undamaged sleeve.

To reduce sound transmission through the panel, pads 60 and 62 (FIGS. 2,3) of a sound-absorbing material such as glass fibre, are disposed between the fabric sleeves 48 and within the perimeter defined by the panel frame members 26, 28, 30 and 32. The pads 60 and 62 are separated by an aluminum foil sheet 64 to minimize the transmission of sound across the panel 10.

To provide the panel 10 with a finished appearance, wood finishing strips 66 (FIGS. 2, 3) are fastened by screws 67 to the outer surfaces of side frame members 26, 28 and upper frame member 30. The side finishing strips 66 have slots 68 in their outer edges for receiving a standard hinge assembly, a portion of which is diagrammatically indicated at 69, so that adjacent panels may be hinged together.

When desks and office equipment are placed near the panel 10 or located on shelves mounted on the panel 10, the wires used in the office equipment often become unsightly and may be a hazard. Therefore the panel 10 includes wire retaining means, provided by two vertical channel members 70 (FIGS. 2,3). Each channel member 70 has a flat base 72 extending in a front to rear direction, and spaced apart front and rear channels 74, 76 having channel openings 78, 80. The channels 74, 76 are located one on each side of each vertical frame member 26, 28. A spline 82 which extends from the base 72 into a groove 84 in the finishing strip 66 locates the channel member 70 prior to assembly. Once the screws 67 are installed, the channel member 70 is firmly clamped between the frame members 26, 28 and the finishing strips 66.

It will be seen that the outer edge of each channel opening 78, 80 is spaced closely to the adjacent edge of its associated sleeve 50. The spacing, indicated by dimension dl, is preferably less than the diameter of many wires and cables. Typically dimension dl is about $\frac{1}{8}$ inch. However, wires or cables thicker than dimension dl may nevertheless be forced through the space indicated by dimension dl and inserted into the channel openings 78, 80.

The resilience of the foam backed fabric material 52, and the flexibility of the edges of the channel member 70 (which is made of resilient plastic) permit these materials to be deformed to allow a wire 83 wider than dimension dl to be inserted into the channel openings. Once the wire is within the channel opening, the space between the edge of the channel member 70 and the edge of the sleeve 48 closes to its original dimension so that the wire will be retained in the channel. Even if the wire diameter is slightly less than dimension dl, as shown for wire 84 in FIG. 3, the normal kinks and curves in a wire ensure that the wire will remain within the channel opening once it is placed there.

It will be seen that because the slots 34 for the shelf backets are recessed between the channel members 70 and the edges of the sleeves 48, the slots 34 are not highly visible. Depending on the thickness of the material 52, the slots 34 may be largely concealed when the sleeves 48 are in position. Shelf brackets can nevertheless be inserted readily, by deforming the material 52 where it interferes with insertion of the brackets.

The panel 10 stands on feet 86 which are adjustable on screws 88 which project from the bottoms of the edge frame members 26, 28. For concealing and carrying wires along the bottom of the panel 10, a wire guide 90 (FIGS. 7,8) is provided, again formed of flexible plastic and having upwardly facing front and rear channel openings 92, 94. The wire guide 90 has a flat base 96 which is adhered to the bottom of lower frame member 32, between the feet 86, by two sided tape (not shown) or by screws. The upper front and rear edges of wire guide 90 are again spaced fron the lower edges of sleeves 50 by the short distance dl, so that the fabric material 52 and the plastic of guide 90 may be deformed to insert a wire into the guide 90.

It will be appreciated that in appropriate circumstances, where no wires will be used, the wire guide channels described may be omitted from the panel. It will also be understood that the sleeves 48 may be made nonremovable and that the same wire guide channels may be used, with the same small spacing between the outer edges of the wire guide channels and the opposed edges of resilient fabric covering used in the panel.

In addition, the channel member 70 and the wire guide 90 may both be made from aluminum or other rigid material is desired, since it is found that the resilience of the foam backed fabric material 52 is sufficient to allow insertion and removal of wires in most cases, without the need to deform the edges of the channel member 70 or of the wire guide 90.

What I claim is:

1. A screen panel comprising:

(a) a frame for said panel, said frame having a closed perimeter and defining front and rear planar surfaces spaced apart in a front to rear direction and extending in parallel lateral planes.

(b) a plurality of clips fixed to said frame and spaced around the perimeter of said frame, some of said clips being associated with said front surface and some of said clips being associated with said rear surface, each clip having a support portion extending in said front to rear direction beyond its associated front or rear surface and a retainer portion extending from the outer end of said support portion and directed outwardly in a direction having a component parallel to a said lateral plane, (c) two sleeves, each sleeve having:

(i) a self supporting subframe formed from a resilient wire rod which defines a closed perimeter, (ii) a fabric material extending across said subframe and covering said wire rod, (d) said wire rod of one sleeve being fitted over said support portions of said clips associated with said front surface and said wire rod of the other sleeve being fitted over said support portions of said clips associated with said rear surface, whereby a said sleeve may be removed from said panel by deforming a portion of its wire rod in a direction generally laterally outwardly to move such portion clear of the retaining portion of a clip on which such portion is fitted, and then moving such portion outwardly in a front to rear direction, away from said frame.

2. A panel according to claim 1 and including a sound absorbing material disposed between said sleeves and retained by said sleeves.

3. A panel according to claim 1 wherein said fabric material includes an outer fabric layer and an inner padding layer, said layers being slit to expose the inner surface of said rod at the location of said clips.

4. A panel according to claim 3 wherein said panel and said sleeves are all substantially rectangular, said frame including a pair of vertical edge members and a pair of vertical extending channel members on fixed over each edge member and disposed with a said sleeve between them, said channel members having opposed inner channel openings facing the vertical edges of said sleeve located between them, said channel members being spaced laterally from said vertical edges of said sleeve located between them, the spacing between the front and rear inner edges of said channel members and the adjacent vertical edges of said sleeves being small, so that a wire may be forced through such spacing into a said channel opening and so that said fabric material will deform as said wire is so inserted, to accommodate passage of said wire.

5. A panel according to claim 4 and further including a further channel member fixed to a lower horizontal edge of said frame; said further channel member being spaced slightly below the bottom edges of said sleeve and having upwardly facing inner front and rear channel openings for receiving and retaining cables, the inner front and rear edges of said last mentioned channel openings being spaced from the bottom edges of said sleeves by said small spacing.

6. A panel according to claim 4 wherein each vertical edge member includes a plurality of vertically aligned vertical slots therein in its front face located between a said channel member and the vertical edge of the sleeve adjacent such channel member, said slots thereby being accessible from the front of said panel, and said slots being adapted to receive shelving brackets.

* * * * *